US011822284B2

(12) United States Patent
Tashiro

(10) Patent No.: US 11,822,284 B2
(45) Date of Patent: Nov. 21, 2023

(54) IMAGE FORMING APPARATUS WITH BRANCHED DUCTS FOR COOLING OF IMAGE FORMING UNITS

(71) Applicant: CANON KABUSHIKI KAISHA, Tokyo (JP)

(72) Inventor: Yuki Tashiro, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/837,597

(22) Filed: Jun. 10, 2022

(65) Prior Publication Data

US 2022/0404763 A1 Dec. 22, 2022

(30) Foreign Application Priority Data

Jun. 16, 2021 (JP) ..... 2021-100083

(51) Int. Cl.
*G03G 21/00* (2006.01)
*G03G 21/20* (2006.01)
*G03G 15/02* (2006.01)

(52) U.S. Cl.
CPC ..... *G03G 21/206* (2013.01); *G03G 15/0258* (2013.01); *G03G 2221/1645* (2013.01)

(58) Field of Classification Search
CPC ..... G03G 21/206; G03G 2221/1645; G03G 15/0258
USPC ..... 399/92
See application file for complete search history.

(56) References Cited

U.S. PATENT DOCUMENTS 6,266,498 B1 * 7/2001 Oda ..... H04N 1/00976 399/92
2005/0025517 A1 * 2/2005 Ito ..... G03G 21/206 399/92
2009/0285588 A1 * 11/2009 Furuichi ..... G03G 21/206 399/27
2014/0294427 A1 * 10/2014 Goda ..... G03G 21/206 399/99
2016/0004216 A1 * 1/2016 Hatanaka ..... G03G 21/206 399/92
2016/0291541 A1 * 10/2016 Yamashita ..... G03G 21/206
2019/0129359 A1 * 5/2019 Takemoto ..... G03G 21/206
2021/0356902 A1 11/2021 Tashiro et al. ..... G03G 21/16

FOREIGN PATENT DOCUMENTS

JP 2010-032780 2/2010

* cited by examiner

*Primary Examiner* — Robert B Beatty
(74) *Attorney, Agent, or Firm* — Venable LLP

(57) ABSTRACT

An image forming apparatus includes a first image forming unit, a second image forming unit, and an intake unit. The intake unit includes an intake duct provided at one side relative to the first and the second image forming units in an arrangement direction of the plurality of image forming units and configured to take in air outside the image forming apparatus from an intake port, a first fan configured to take in air from a first communication port, and a second fan configured to take in air from a second communication port. The intake unit branches air taken in from the intake duct to the air taken in from the first communication port by the first fan and the air taken in from the second communication port by the second fan, and blows the air to each of the first image forming unit and the second image forming unit.

20 Claims, 10 Drawing Sheets

IMAGE FORMING APPARATUS WITH BRANCHED DUCTS FOR COOLING OF IMAGE FORMING UNITS

BACKGROUND OF THE INVENTION

Field of the Invention

The present invention relates to an image forming apparatus such as a printer, a copier, a facsimile, or a multifunction peripheral.

Description of the Related Art

In an image forming apparatus, a toner image is formed on an image bearing member such as a photosensitive drum or an intermediate transfer belt, the toner image is transferred from the image bearing member to a recording material, and then heat and pressure are applied by a fixing unit to fix the toner image on the recording material. In such an image forming apparatus that forms an image on a recording material using toner, a developing unit that develops an electrostatic latent image of the image bearing member using the toner is provided. The developing unit accommodates the toner therein, and circulates and conveys the toner while stirring the toner by a conveying screw in the developing unit. Therefore, the developing unit generates heat in response to a toner stirring operation. As described above, a plurality of units that generates heat, such as the fixing unit and the developing unit, are provided inside the image forming apparatus.

Therefore, conventionally, a configuration has been proposed in which a plurality of cooling targets such as a fixing unit and a developing unit are cooled by outside air taken in from an intake port by an intake fan (Japanese Patent Application Laid-Open No. 2010-32780). In the device described in Japanese Patent Application Laid-Open No. 2010-32780, in order to efficiently blow air to each of the plurality of cooling targets, a plurality of fans is provided, and ducts connecting the fans from the intake ports are provided for the number of fans. In this case, each of the plurality of cooling targets can be efficiently cooled.

Meanwhile, an image forming apparatus that forms an image on a recording material using toners of a plurality of colors includes a plurality of image forming units (also referred to as image forming stations) that form toner images of respective colors on a photosensitive drum for each color. In the case of including a plurality of image forming units, it is necessary to cool each cooling target included in each image forming unit. In this case, as in the device described in Japanese Patent Application Laid-Open No. 2010-32780, when the plurality of ducts is provided for connecting the fan from the intake port for each of a plurality of cooling targets, a sufficient air blowing amount to each cooling target can be secured, but an area occupied by the ducts increases in the image forming apparatus. Therefore, conventionally, in order to secure a space for individually disposing the fan and the duct for each of the plurality of units, it is necessary to increase the size of the device. However, this goes against a recent demand for miniaturization of the device, and thus it is difficult to adopt the device.

In view of the above problems, there is need for providing an image forming apparatus capable of suppressing an increase in size of the apparatus and guiding outside air taken in by an intake fan with a sufficient air blowing amount secured when the outside air is guided toward a plurality of units via ducts.

SUMMARY OF THE INVENTION

According to a first aspect of the present invention, an image forming apparatus configured to form an image on a recording material includes a first image forming unit among a plurality of image forming units, the first image forming unit having a first photosensitive member, a first charging unit configured to charge the first photosensitive member by corona discharge, and a first developing unit configured to develop an electrostatic latent image formed on the first photosensitive member using toner, a second image forming unit among the plurality of image forming units, the second image forming unit having a second photosensitive member, a second charging unit configured to charge the second photosensitive member by corona discharge, and a second developing unit configured to develop an electrostatic latent image formed on the second photosensitive member using toner, and an intake unit including an intake duct provided at one side relative to the first and the second image forming units in an arrangement direction of the plurality of image forming units and configured to take in air outside the image forming apparatus from an intake port, a first fan configured to take in air from a first communication port formed in a first side surface portion of the intake duct, and a second fan configured to take in air from a second communication port formed in a second side surface portion facing the first side surface portion of the intake duct. The intake unit is configured to branch air in the intake duct to the air taken in from the first communication port by the first fan and the air taken in from the second communication port by the second fan, and blow the air to each of the first image forming unit and the second image forming unit.

Further features of the present invention will become apparent from the following description of exemplary embodiments with reference to the attached drawings.

DESCRIPTION OF THE EMBODIMENTS

Image Forming System

Figure 1:
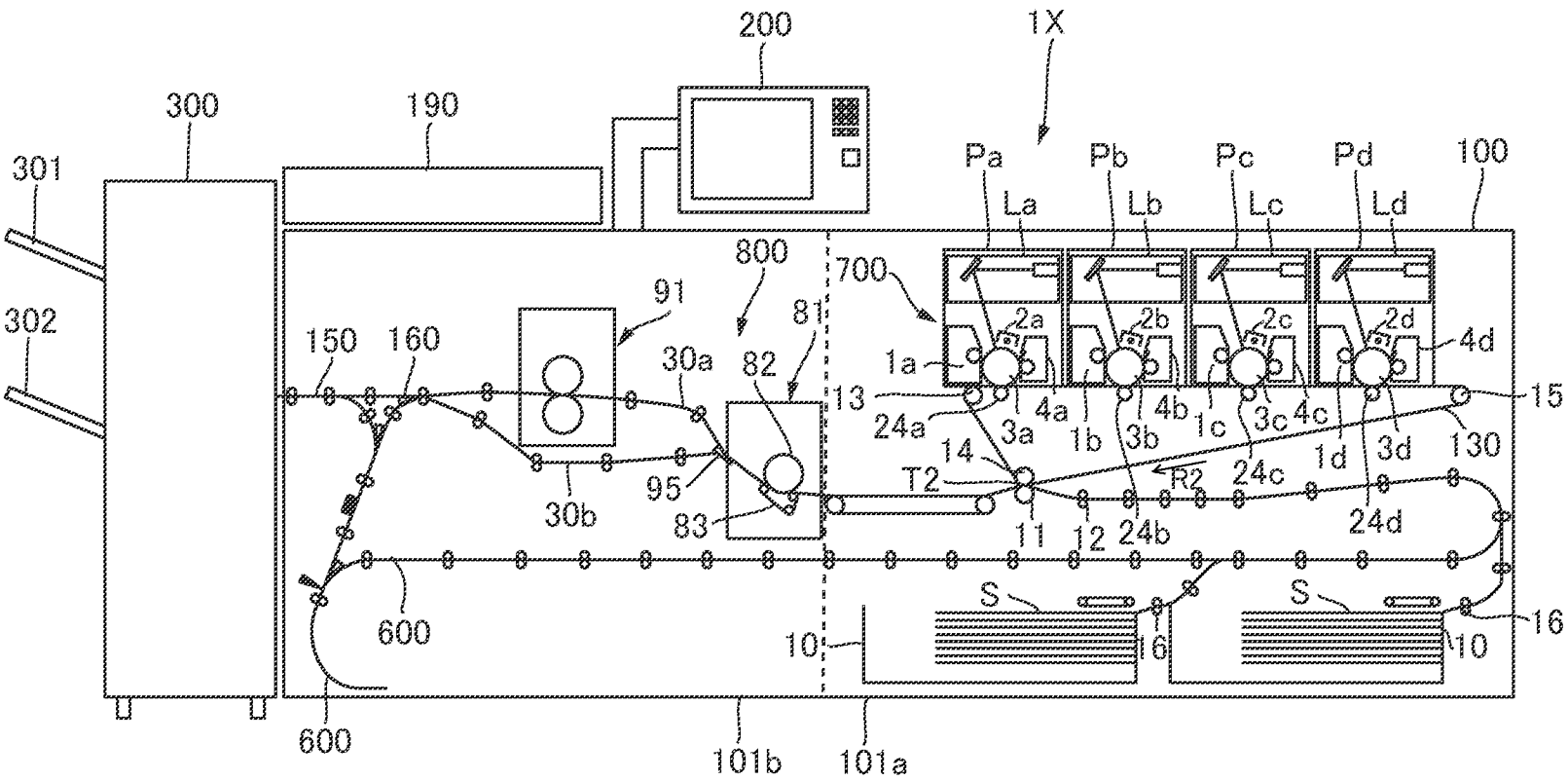
FIG. 1 is a schematic diagram illustrating an image forming system including an image forming apparatus according to the present embodiment.

A schematic configuration of an image forming system including an image forming apparatus of the present embodiment will be described with reference to FIG. 1. An image forming system 1X illustrated in FIG. 1 includes an image forming apparatus 100 and a finisher device 300. The image forming apparatus 100 and the finisher device 300 are connected so as to be able to transfer a recording material S. In the present embodiment, the finisher device 300 is a post-process unit that can be retrofitted to the image forming apparatus 100 for function enhancement, and can perform a post-process to be described below on the recording material S on which a toner image is fixed by the image forming apparatus 100. The image forming apparatus 100 and the finisher device 300 are connected to each other to be able to transmit and receive data therebetween through a communication interface capable of serial communication and parallel communication.

Image Forming Apparatus

The image forming apparatus 100 is an electrophotographic tandem full-color printer, and includes a first casing 101*a* and a second casing 101*b*. In the first casing 101*a*, various devices such as an image forming unit 700 that realizes a process of conveying the recording material S and transferring the toner image, various members, and the like are disposed.

Meanwhile, in the second casing 101*b*, various devices such as a fixing unit 800 that realizes a process of conveying the recording material S and fixing the toner image, various members, and the like are disposed. In addition, the second casing 101*b* is provided with an operation unit 200 having a display unit capable of displaying various types of information on the front side, a key capable of inputting various types of information according to a user operation, and the like. An electric unit (not illustrated) having a power supply board may be disposed on the back side of the first casing 101*a* and the second casing 101*b*. In the present specification, in order to operate the image forming apparatus 100 by the user, a side on which a user stands when operating the operation unit 200 is referred to as a "front surface", and an opposite side thereof is referred to as a "back surface". In addition, a side surface on a left side when viewed from the front is referred to as a "left surface", and a side surface on the right side when viewed from the front is referred to as a "right surface".

The image forming apparatus 100 includes image forming portions Pa, Pb, Pc, and Pd that form yellow, magenta, cyan, and black images, respectively. The image forming apparatus 100 forms a toner image on the recording material S according to an image signal received from an external device (not illustrated) such as the document reading apparatus 190 or a personal computer that reads an image signal from a document.

In the case of the present embodiment, the image forming portions Pa to Pd, primary transfer rollers 24*a* to 24*d*, an intermediate transfer belt 130, plurality of rollers 13 to 15, and a secondary transfer outer roller 11 constitute an image forming unit 700 that forms a toner image on the recording material S. Examples of the recording material S include paper such as plain paper, thick paper, rough paper, uneven paper, and coated paper, a plastic film, cloth, and the like.

As illustrated in FIG. 1, the image forming portions Pa to Pd are arranged side by side along a moving direction of the intermediate transfer belt 130. The intermediate transfer belt 130 is stretched around the plurality of rollers 13, 14, and 15 and moved in a direction of an arrow R2. Then, the intermediate transfer belt 130 carries and conveys a toner image to be primarily transferred as described below. The secondary transfer outer roller 11 is disposed at a position interposed between the secondary transfer inner roller 14 stretching the intermediate transfer belt 130 and the intermediate transfer belt 130 to face the secondary transfer inner roller 14 and the intermediate transfer belt 130, and forms a secondary transfer portion T2 that transfers the toner image on the intermediate transfer belt 130 to the recording material S. A fixing unit 800 is disposed downstream of the secondary transfer portion T2 in a recording material conveyance direction.

On the lower side of the image forming apparatus 100, a plurality of (here, two) cassettes 10 in which recording materials S are accommodated are arranged. The recording materials S having different sizes and thicknesses are accommodated in the cassettes 10, and the recording material S is selectively conveyed from one of the cassettes 10. The recording material S is conveyed from the cassette 10 toward a registration roller 12 through a conveying path by a conveying roller 16. Thereafter, the registration roller 12 rotates in synchronization with the toner image formed on the intermediate transfer belt 130, whereby the recording material S is conveyed toward the secondary transfer portion T2. Note that the recording material S is not limited to the recording material S stored in the cassette 10, and the recording material S placed on a manual feed unit (not illustrated) may be conveyed.

The image forming portions Pa, Pb, Pc, and Pd have substantially the same configuration except that developed colors of the toner images are different. Therefore, here, the yellow image forming portion Pa will be described as a representative, and description of the other image forming portions Pb, Pc, and Pd will be omitted.

In the image forming portion Pa, a cylindrical photosensitive drum 3*a* is disposed as a photosensitive member. The photosensitive drum 3*a* is rotationally driven by a motor (not illustrated). A charging unit 2*a*, an exposing unit La, a developing unit 1*a*, the primary transfer roller 24*a*, and a drum cleaning unit 4*a* are disposed around the photosensitive drum 3*a*. In the present embodiment, the image forming portion Pa is an example of a first image forming unit which is one of a plurality of image forming units. The image forming portion Pa includes the photosensitive drum 3*a* which is an example of a first photosensitive member, the charging unit 2*a* which is an example of a first charging unit that charges the photosensitive drum 3*a* by corona discharge, and the developing unit 1*a* which is an example of a first developing unit that develops an electrostatic latent image formed on the photosensitive drum 3*a* using toner. In the present embodiment, the image forming portion Pb is an example of a third image forming unit which is one of the plurality of image forming units. The image forming portion Pb includes a photosensitive drum 3*b* that is an example of the third photosensitive member, a charging unit 2*b* that is an example of a third charging unit that charges the photosensitive drum 3*b* by corona discharge, and a developing unit 1*b* that is an example of a third developing unit that develops an electrostatic latent image formed on the photosensitive drum 3*b* using toner. In the present embodiment, the image forming portion Pc is an example of a fourth image forming unit which is one of the plurality of image forming units. The image forming portion Pc includes a photosensitive drum 3*c* which is an example of a fourth photosensitive member, a charging unit 2*c* which is an example of a fourth charging unit that charges the photosensitive drum 3*c* by corona discharge, and a developing unit 1*c* which is an example of a fourth developing unit that develops an electrostatic latent image formed on the photosensitive drum 3*c* using toner. In the present embodiment, the image forming portion Pd is an example of a second image forming unit which is one of the plurality of image forming units. The image forming portion Pd includes a photosensitive drum 3*d* which is an example of a second photosensitive member, a charging unit 2*d* which is an example of a second charging unit that charges the photosensitive drum 3*d* by corona discharge, and a developing unit 1*d* which is an example of a second developing unit that develops an electrostatic latent image formed on the photosensitive drum 3*d* using toner.

For example, a process of forming a full-color image by the image forming apparatus 100 will be described. First, when the image forming operation is started, the surface of the rotating photosensitive drum 3*a* is uniformly charged by the charging unit 2*a*. The charging unit 2*a* is, for example, a corona charger that irradiates charged particles associated with corona discharge to charge the surface of the photosensitive drum 3*a* to a uniform potential. Next, the photosensitive drum 3*a* is scanned and exposed by a laser beam corresponding to an image signal emitted from the exposing unit La. As a result, an electrostatic latent image corresponding to the image signal is formed on the surface of the photosensitive drum 3*a*. The electrostatic latent image formed on the photosensitive drum 3*a* is developed into a toner image that is a visible image by a developer containing toner and a carrier stored in the developing unit 1*a*. In other words, the toner image is developed on the photosensitive drum 3*a* by the toner supplied by the developing unit 1*a*. In the developing units 1*a* to 1*d*, the developer is circularly conveyed while being stirred by a conveying screw (not illustrated).

The toner image formed on the photosensitive drum 3*a* is primarily transferred to the intermediate transfer belt 130 at a primary transfer portion T1 configured between the primary transfer roller 24*a* and the photosensitive drum 3*a*, the primary transfer roller 24*a* being disposed with the intermediate transfer belt 130 interposed therebetween. At this time, a primary transfer voltage is applied to the primary transfer roller 24*a*. The toner remaining on the surface of the photosensitive drum 3*a* after the primary transfer is removed by the drum cleaning unit 4*a*.

Such an operation is sequentially performed in the yellow, magenta, cyan, and black image forming portions Pa to Pd, and toner images of four colors are superimposed on the intermediate transfer belt 130. Thereafter, the recording material S accommodated in the cassette 10 is conveyed to the secondary transfer portion T2 in accordance with the formation timing of the toner image. Then, by applying a secondary transfer voltage to the secondary transfer outer roller 11, the full-color toner images formed on the intermediate transfer belt 130 are secondarily transferred collectively to the recording material S. The toner remaining on the intermediate transfer belt 130 after the secondary transfer is removed by a belt cleaning unit (not illustrated).

In the present embodiment, the photosensitive drum 3*a* corresponds to the first photosensitive member, and the photosensitive drums 3*b*, 3*c*, and 3*d* correspond to the second photosensitive members. The developing unit 1*a* corresponds to a first developing unit, and the developing units 1*b*, 1*c*, and 1*d* correspond to second developing units.

The recording material S to which the toner image has been transferred is conveyed to the fixing unit 800. The fixing unit 800 fixes the toner image on the recording material S by applying heat and pressure to the recording material S to which the toner image has been transferred. In the case of the present embodiment, it is possible to selectively apply heat and pressure to the recording material S by a first fixing device 81 and then further apply heat and pressure by a second fixing device 91. In the fixing unit 800, whether the recording material S is conveyed toward the second fixing device 91 after passing through the first fixing device 81 or is conveyed while avoiding the second fixing device 91 after passing through the first fixing device 81 is switched by a fixing switching member 95.

The second fixing device 91 is disposed on the downstream of the first fixing device 81 in the conveyance direction of the recording material S. The second fixing device 91 is selectively used for the purpose of further adding gloss to the toner image on the recording material S fixed by the first fixing device 81. For example, in a case where the recording material S is coated paper such as glossy paper or synthetic paper, the recording material S having passed through the first fixing device 81 is conveyed along a fixing route 30*a* so that fixing is performed by both the first fixing device 81 and the second fixing device 91. Meanwhile, in a case where the recording material S is non-coated paper such as plain paper, the recording material S having passed through the first fixing device 81 is conveyed along a fixing-by-pass route 30*b* avoiding the second fixing device 91 so that the fixing is not performed in the second fixing device 91 while the fixing is performed in the first fixing device 81.

Since the first fixing device 81 and the second fixing device 91 may have the same configuration, the first fixing device 81 will be described as an example. The first fixing device 81 includes a fixing roller 82 (or a fixing belt) that is rotatable in contact with a surface of the recording material S on which the toner image is fixed, and a pressure belt 83 (or a pressure roller) that is pressed against the fixing roller 82 to form a fixing nip portion. At least one of the fixing roller 82 and the pressure belt 83 is heated by a heater (not illustrated). The first fixing device 81 applies heat and pressure to the recording material S at the time of nipping and conveying the recording material S on which the toner image is formed in the fixing nip portion formed by the fixing roller 82 and the pressure belt 83 to fix the toner image on the recording material S.

In the present embodiment, the image forming apparatus 100 can perform duplex printing. In the case of single-sided printing, the recording material S on which the toner image is fixed is conveyed to a discharge conveyance path 150 and discharged to the outside of the image forming apparatus 100. In the case of duplex printing, the recording material S on which the toner image is fixed is conveyed to a duplex reverse conveyance path 600. The duplex reverse conveyance path 600 is formed across the first casing 101*a* and the second casing 101*b*. In the duplex reverse conveyance path 600, the recording material S is reversed by the switchback operation, and the front surface and the back surface of the recording material S are exchanged. The reversed recording material S is conveyed toward the registration roller 12, and is conveyed to the secondary transfer portion T2 by the registration roller 12 in a state where the back surface side that is not printed faces the intermediate transfer belt 130 side. In the secondary transfer portion T2, the full-color toner images formed on the intermediate transfer belt 130 are secondarily transferred collectively to the recording material S (back surface side). Thereafter, the toner image is fixed by the fixing unit 800, and the recording material S is discharged to the outside of the image forming apparatus 100 in a state where a surface (image forming surface) on which an image has been formed immediately before faces upward. The above-described switching between the discharge conveyance path 150 and the duplex reverse conveyance path 600 is performed by a conveyance switching member 160. In the present embodiment, two fixing devices are provided as the fixing unit 800, but only one fixing device may be provided. In addition, a cooling unit that cools the recording material S on which the toner image is fixed by the fixing unit 800 may be provided in the second casing 101*b*.

The finisher device 300 is connected to the image forming apparatus 100 so as to be able to transfer the recording material S, and the recording material S discharged from the image forming apparatus 100 is conveyed to the finisher device 300. The recording material S conveyed to the finisher device 300 is subjected to post-process processing such as punching processing of forming a hole in the recording material S by the finisher device 300 or stapling processing of bundling and needle-closing a plurality of recording materials S. In the finisher device 300, the holed recording material S is separately discharged to an upper sheet discharge tray 301, and the bundle of the needle-closed recording materials S is separately discharged to a lower sheet discharge tray 302.

Figure 2:
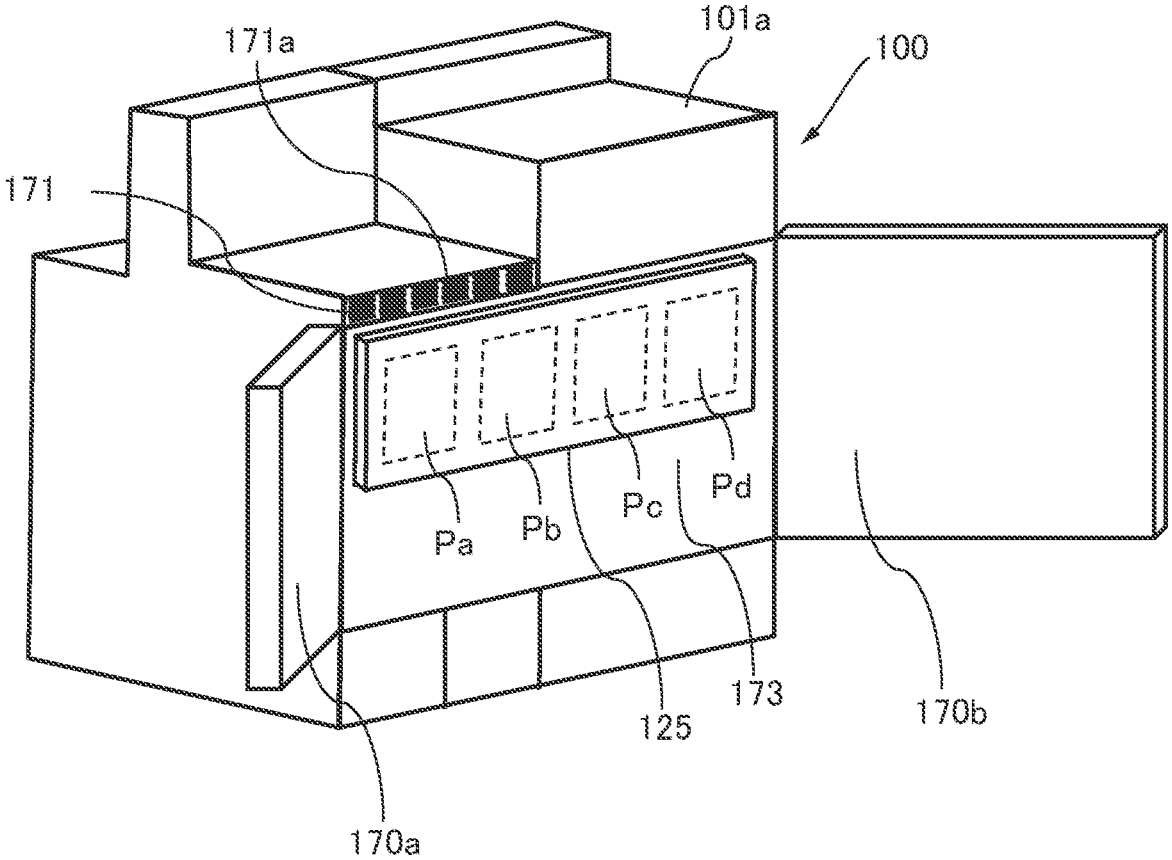
FIG. 2 is a left perspective view illustrating a state in which a front door of the image forming apparatus is opened.
Figure 3A:
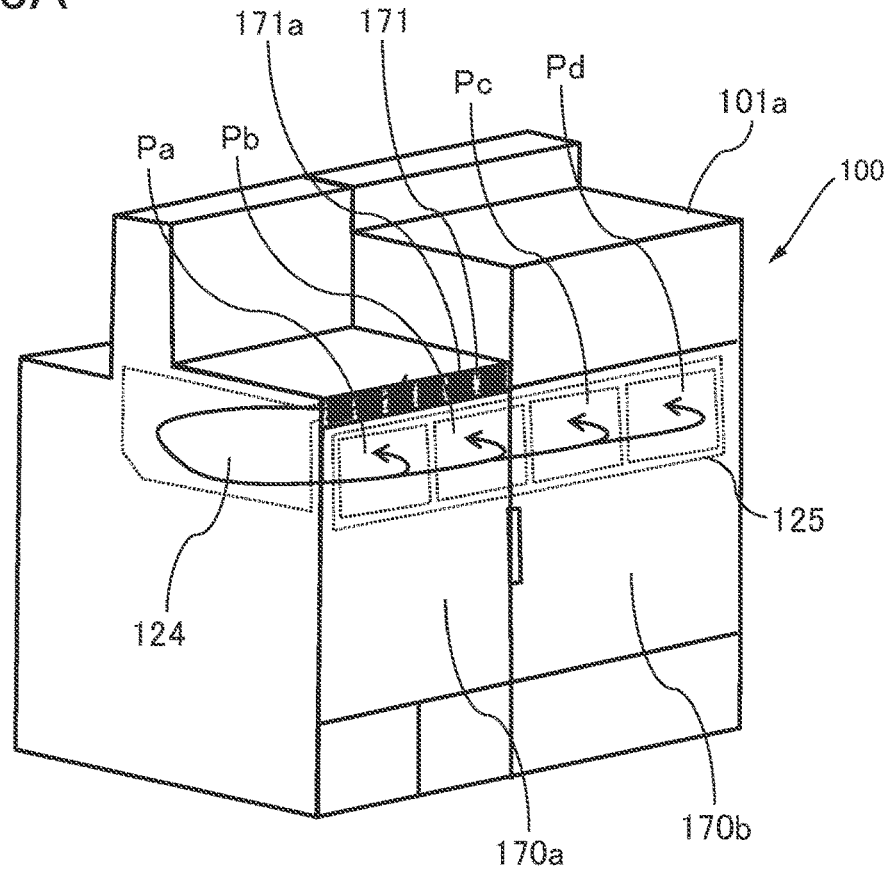
FIG. 3A is a left perspective view illustrating a state in which a front door of the image forming apparatus is closed.

Hereinafter, an airflow configuration of outside air in the image forming apparatus 100 will be described with reference to FIGS. 2 to 9 with reference to FIG. 1. FIG. 2 is a left perspective view illustrating the image forming apparatus 100 in a state where a front door is opened. FIG. 3A is a left perspective view illustrating a state in which the front door of the image forming apparatus 100 is closed, and FIG. 3B is a right perspective view illustrating a state in which the front door of the image forming apparatus 100 is closed.

As illustrated in FIG. 2, left front door 170*a* and right front door 170*b* as exterior covers are provided on a front surface of first casing 101*a* so as to be openable and closable in a double doors manner as illustrated in the drawing. On the front surface of the first casing 101*a*, an inner cover 173 is provided inside the left front door 170*a* and right front door 170*b*. The inner cover 173 is provided to prevent a user from erroneously touching a movable portion, electric wiring, or the like in first casing 101*a* when the user opens the front doors (170*a* and 170*b*). However, the inner cover 173 is detachably attached to the first casing 101*a* with a screw or the like so that a service engineer can perform maintenance work. The inner cover 173 is formed with an opening portion through which the image forming portions Pa to Pd (illustrated by dotted lines) can be individually inserted into and removed from the first casing 101*a*, and an inner cover unit 125 is detachably provided on the inner cover 173 so as to cover the image forming portions Pa to Pd.

As illustrated in FIGS. 2 and 3A, an intake cover 171 is provided above the left front door 170*a*, and an intake port 171*a* is formed in the intake cover 171. On the left surface side of the first casing 101*a*, a left intake unit 124 having a fan (see FIGS. 4A and 4B described below) that takes in outside air from the intake port 171*a* is provided. In the present embodiment, the outside air taken in from the intake port 171*a* is guided toward the image forming portions Pa to Pd and the charging units 2*a* and 2*b* via the left intake unit 124 and the inner cover unit 125.

Figure 3B:
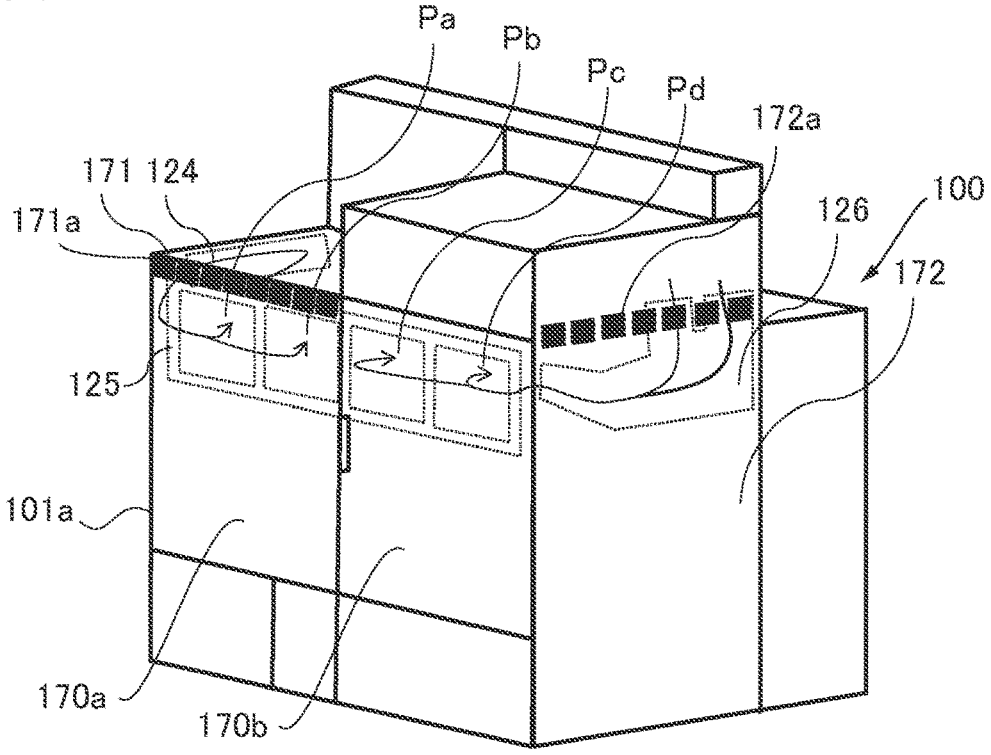
FIG. 3B is a right perspective view illustrating a state in which the front door of the image forming apparatus is closed.

As illustrated in FIG. 3B, a right cover 172 is provided on the right surface of the first casing 101*a*, and an intake port 172*a* is formed in the right cover 172. A right intake unit 126 having a fan (see FIG. 4B described below) for taking in outside air is provided on the right surface side of the first casing 101*a*, and the outside air is taken in from the intake port 172*a* according to the operation of the fan. In the present embodiment, the outside air taken in from the intake port 172*a* is guided to the charging units 2*c* and 2*d* via the right intake unit 126 and the inner cover unit 125.

In the charging units 2*a* to 2*d*, the surfaces of the photosensitive drums 3*a* to 3*d* are charged by ionizing air by corona discharge to generate ions. In addition, the charging units 2*a* to 2*d* generate not only ions but also ozone during the corona discharge. However, since the ozone easily corrodes, for example, a stainless steel grid (not illustrated) or the like included in the charging units 2*a* to 2*d*, ozone needs to be recovered. Therefore, although in the vicinity of the charging units 2*a* to 2*d*, a primary intake duct (not illustrated) that blows outside air to the charging units 2*a* to 2*d* and a primary exhaust duct (not illustrated) that exhausts air to the outside of the image forming apparatus 100 via the ozone recovery filter are disposed in order to send ozone to an ozone recovery filter (not illustrated) by outside air for recovery.

Left Intake Unit

The left intake unit 124 will be described with reference to FIGS. 4A to 7 with reference to FIG. 1. However, in order to facilitate understanding of the description, FIGS. 4A and 4B illustrate the airflow configurations of the developing units 1*a* to 1*d* and the airflow configurations of the charging units 2*a* to 2*d* separately.

Figure 4A:
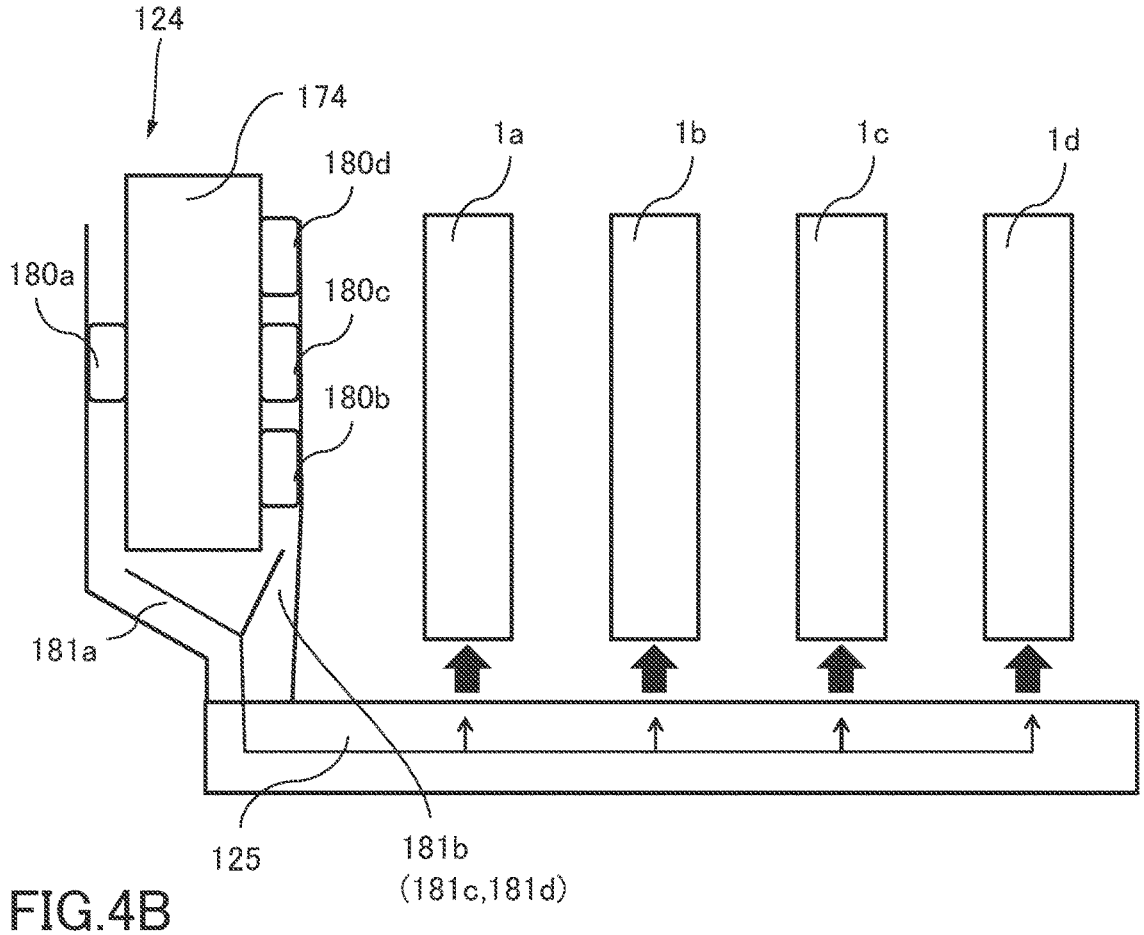
FIG. 4A is a schematic diagram illustrating an airflow configuration of a developing unit.
Figure 4B:
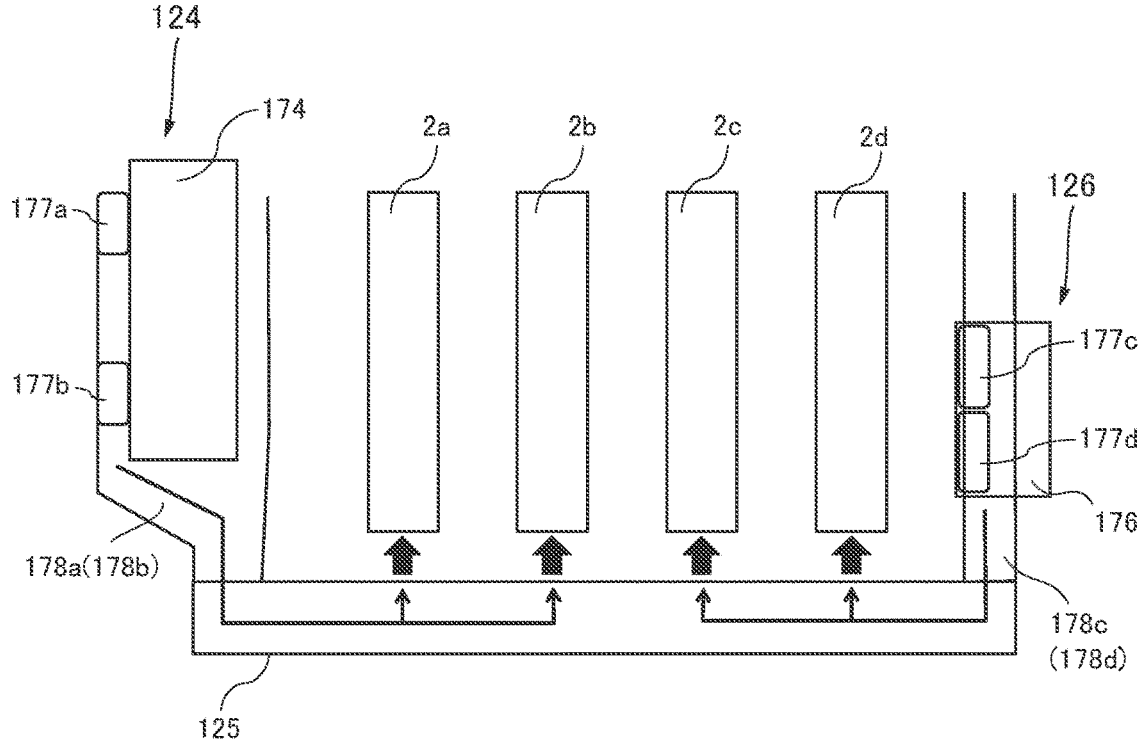
FIG. 4B is a schematic diagram illustrating an airflow configuration of a charging unit.

As illustrated in FIGS. 4A and 4B, the left intake unit 124 includes a left main body duct 174, developing intake fans 180*a*, 180*b*, 180*c*, and 180*d*, charging intake fans 177*a* and 177*b*, and side ducts 174*a* and 174*b* described below. The developing intake fans 180*a* to 180*d* are sirocco fans for cooling the developing units 1*a* to 1*d* supported by the first casing 101*a*. The charging intake fans 177*a* and 177*b* are sirocco fans for sending outside air to the charging units 2*a* and 2*b* supported by the first casing 101*a*. The left main body duct 174 is a duct in which a space communicating with the intake port 171*a* is formed.

Figure 5A:
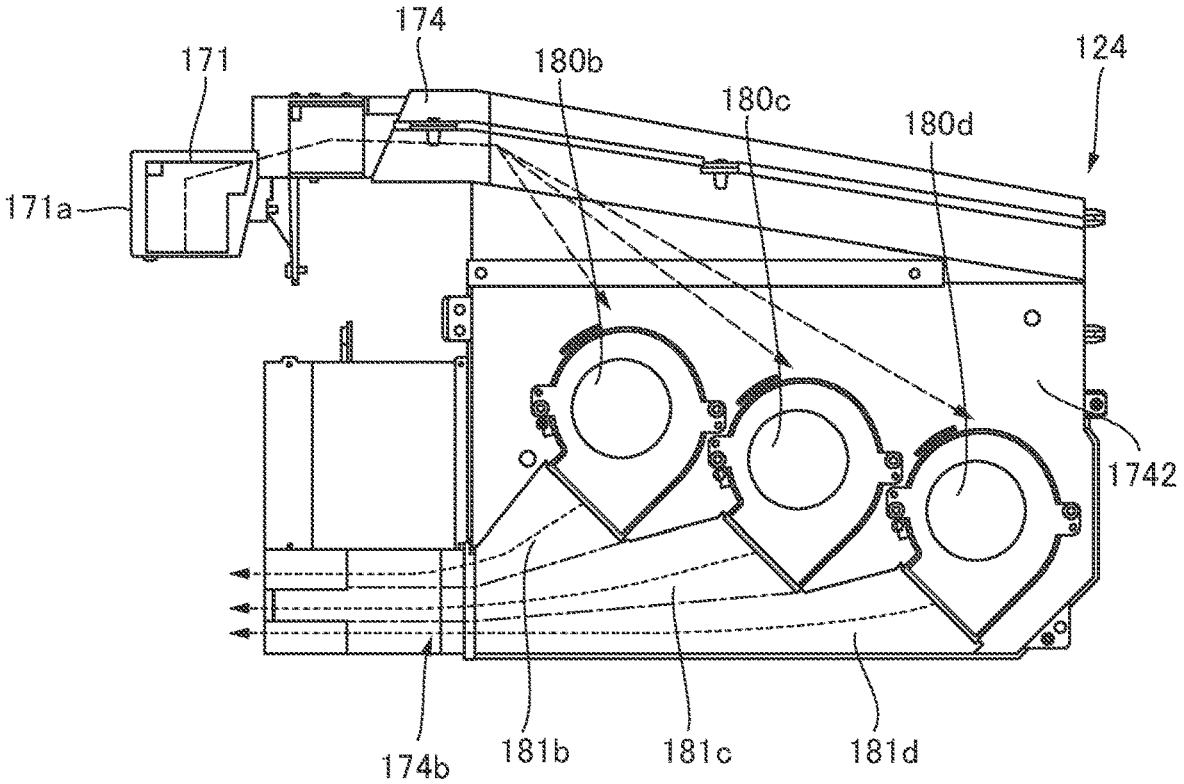
FIG. 5A is a right side view illustrating a left intake unit.
Figure 5B:
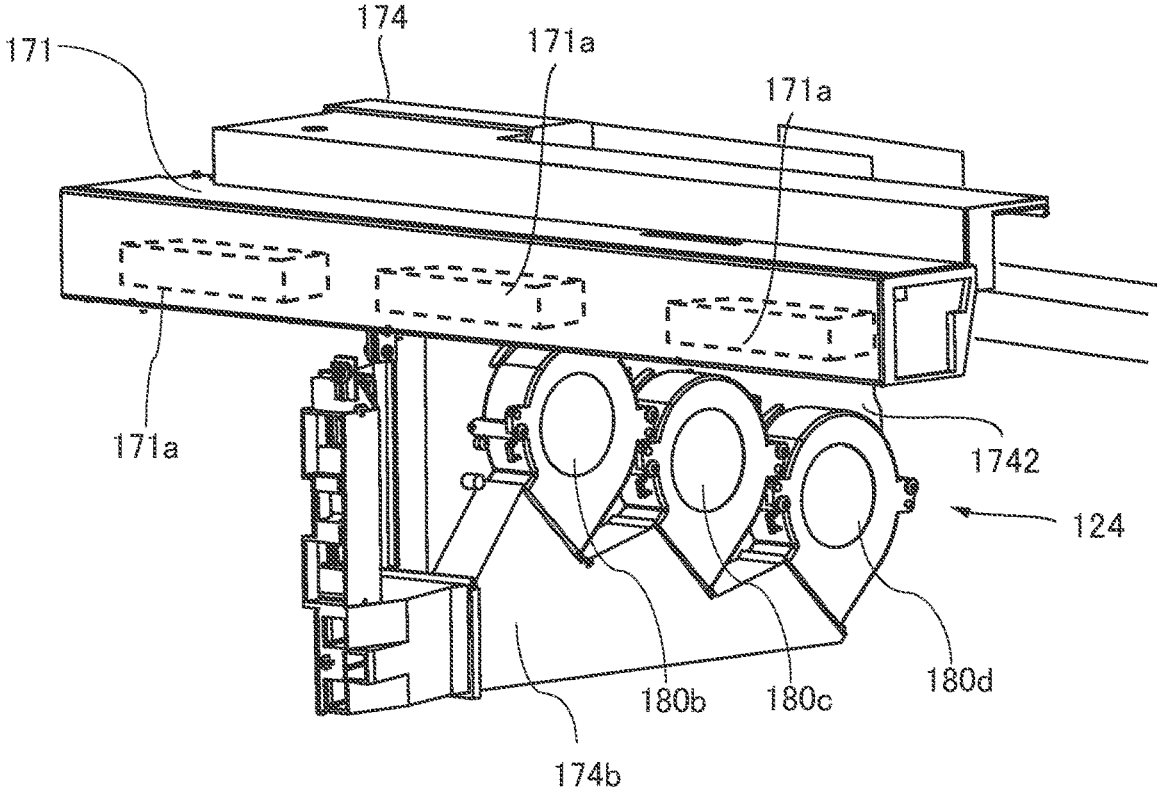
FIG. 5B is a right perspective view illustrating the left intake unit.

As illustrated in FIGS. 5A and 5B, the developing intake fan 180*d* as a second fan, the developing intake fan 180*b* as a third fan, the developing intake fan 180*c* as a fourth fan, and the side duct 174*b* are disposed on a right surface portion 1742 of the left main body duct 174 as an intake duct. That is, a communication port communicating with the developing intake fans 180*b*, 180*c*, and 180*d* is formed in the right surface portion 1742 as the second side surface portion, and the outside air taken in from the intake port 171*a* according to the operation of the developing intake fans 180*b*, 180*c*, and 180*d* passes through the inside of the left main body duct 174. The developing ducts 181*b*, 181*c*, and 181*d* as second ducts are formed inside the side duct 174*b*. The side duct 174*b* and the developing intake fans 180*b*, 180*c*, and 180*d* are connected such that the outside air passing through the developing intake fans 180*b*, 180*c*, and 180*d* branches and passes through the developing ducts 181*b*, 181*c*, and 181*d*. In the present embodiment, the developing ducts 181*b*, 181*c*, and 181*d* are examples of branch portions. The left main body duct 174 is provided at one side relative to the image forming portions Pa and Pd in the arrangement direction of the plurality of image forming units and configured to take in air outside the image forming apparatus 100 from the intake port 171*a*.

Figure 6A:
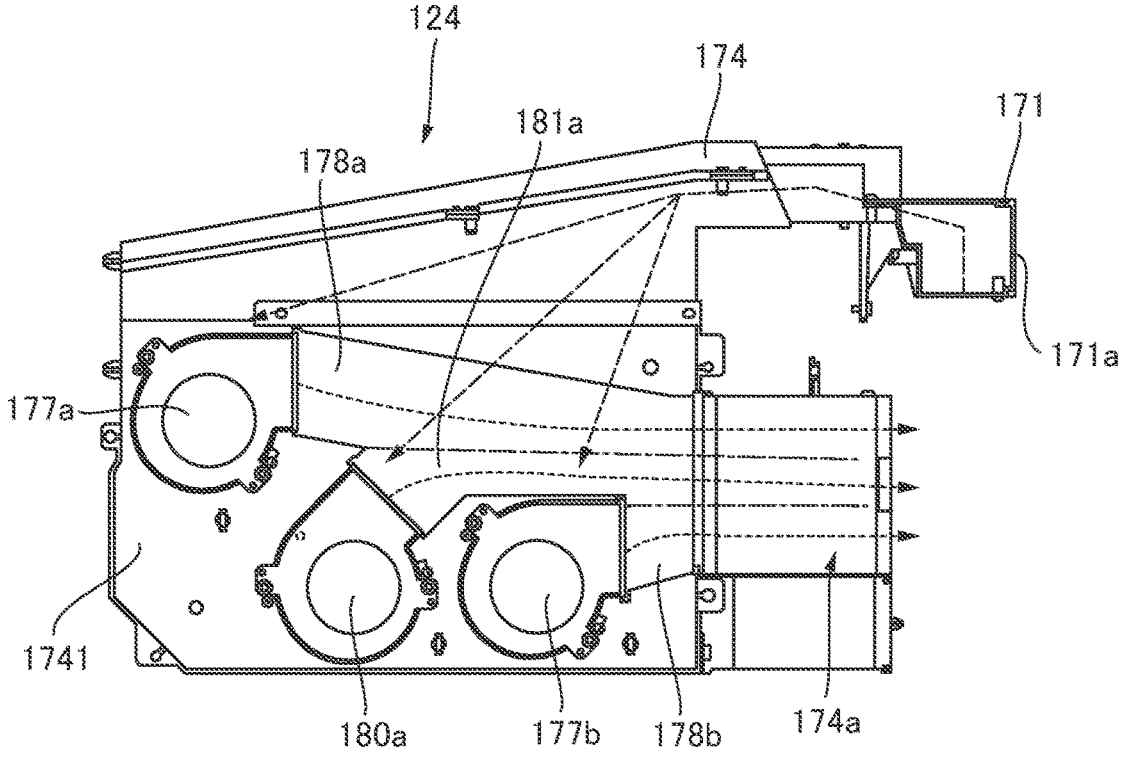
FIG. 6A is a left side view illustrating the left intake unit.
Figure 6B:
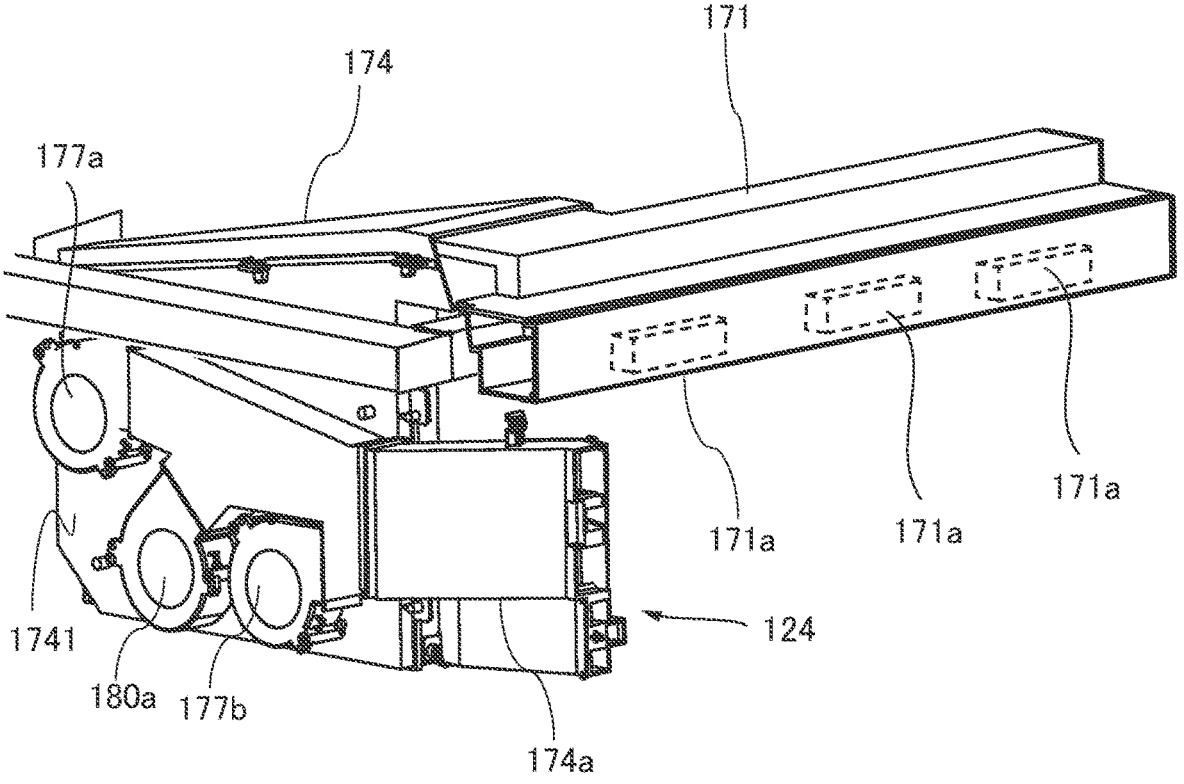
FIG. 6B is a left perspective view illustrating the left intake unit.

Meanwhile, as illustrated in FIGS. 6A and 6B, the developing intake fan 180*a*, the charging intake fans 177*a* and 177*b*, and the side duct 174*a* are disposed on a left surface portion 1741 facing the right surface portion 1742 with a distance therebetween in the left main body duct 174. That is, a communication port communicating with the developing intake fan 180*a* and the charging intake fans 177*a* and 177*b* as the first fans is formed in the left surface portion 1741 as the first side surface portion, and the outside air taken in from the intake port 171*a* according to the operations of the developing intake fan 180*a* and the charging intake fans 177*a* and 177*b* passes through the inside of the left main body duct 174. The developing duct 181*a* as a first duct and charging ducts 178*a* and 178*b* are formed inside the side duct 174*a*. The side duct 174*a*, the developing intake fan 180*a*, and the charging intake fans 177*a* and 177*b* are connected such that the outside air passing through the developing intake fan 180*a* and the charging intake fans 177*a* and 177*b* branches and passes through the ducts 181*a*, 178*a*, and 178*b*.

Then, as illustrated in FIG. 4A, the outside air taken in from the intake port 171*a* is sent to the developing units 1*a* to 1*d* via the left main body duct 174, the developing intake fans 180*a* to 180*d*, the developing ducts 181*a* to 181*d*, and the inner cover unit 125. As illustrated in FIG. 4B, the outside air taken in from the intake port 171*a* is sent to the charging units 2*a* and 2*b* via the left main body duct 174, the charging intake fans 177*a* and 177*b*, the charging ducts 178*a* and 178*b*, and the inner cover unit 125. In order to remove dust and the like from the outside air taken in from the intake port 171*a*, a filter (not illustrated) is preferably disposed in a flow path from the intake port 171*a* to the left main body duct 174.

In the present embodiment, the developing intake fans 180*a* to 180*d* and the charging intake fans 177*a* and 177*b*, which are sirocco fans, are disposed on the left surface portion 1741 and the right surface portion 1742 of the left main body duct 174 with the intake side facing the left main body duct 174. As described above, in the left main body duct 174, the developing intake fan 180*a* and the charging intake fans 177*a* and 177*b* are disposed on the left surface portion 1741, and the developing intake fans 180*b*, 180*c*, and 180*d* are disposed on the right surface portion 1742. As described above, by using the ducts from the intake port 171*a* to the developing intake fans 180*a* to 180*d* and the charging intake fans 177*a* and 177*b* as a common duct, it is possible to reduce the area occupied by the ducts as compared with a configuration in which the ducts connecting the fan and the intake port are provided for the number of the plurality of fans, and it is possible to suppress an increase in size of the image forming apparatus itself due to an increase in size of the duct. In addition, since the arrangement of the ducts can be simplified, the degree of freedom in design can be improved without affecting the arrangement of other units.

Figure 7:
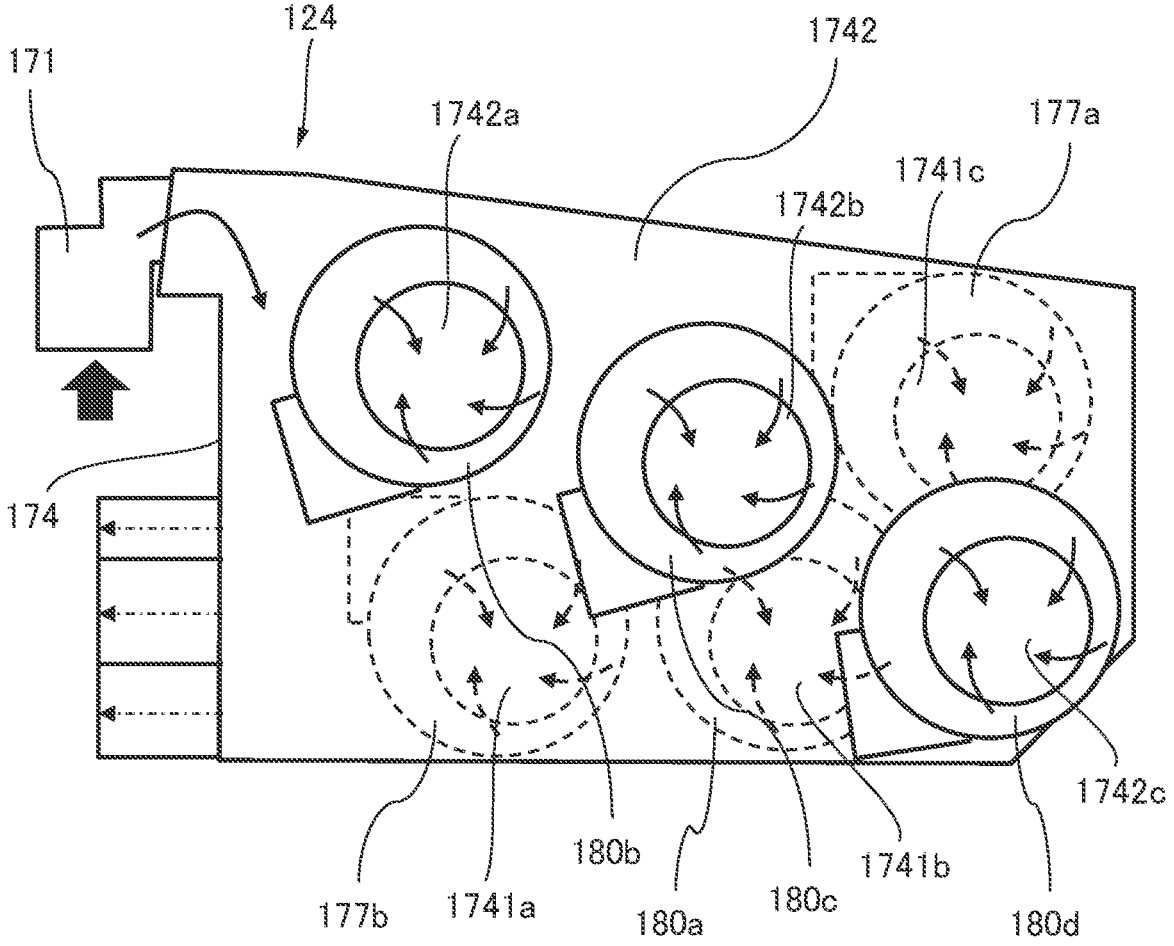
FIG. 7 is a schematic view illustrating an arrangement position of each intake fan in the left intake unit.

When the developing intake fans 180*a* to 180*d* and the charging intake fans 177*a* and 177*b* are disposed in the left main body duct 174, the inventors have studied arrangement positions where the intake fans are not easily affected by intake air by other intake fans by air flow simulation. FIG. 7 illustrates the arrangement positions of the developing intake fans 180*a* to 180*d* and the charging intake fans 177*a* and 177*b* in the left intake unit 124.

As illustrated in FIG. 7, the developing intake fans 180*a* to 180*d* and the charging intake fans 177*a* and 177*b* are disposed at positions not overlapping with each other in an intake direction. In order to achieve this, in the left main body duct 174, the communication ports 1741*a* to 1741*c* (first communication ports), the communication port 1742*a* (third communication port), the communication port 1742*b* (fourth communication port), and the communication port 1742*c* (the second communication port) are formed so as not to overlap each other when viewed from the right surface portion 1742 side (the second side surface portion side) toward the left surface portion 1741 side (the first side surface portion side) in the passing direction (the rotation axis direction of the fan) of the outside air passing through the developing intake fan 180*a* (the first fan). That is, the communication ports 1741*a* to 1741*c* and the communication ports 1742*a* to 1742*c* are formed so as not to overlap each other when viewed from the right surface portion 1742 side to the left surface portion 1741 side in the opposing direction where the left surface portion 1741 side and the right surface portion 1742 side are facing each other.

As described above, the communication ports 1741*a* to 1741*c* and 1742*a* to 1742*c* in the left main body duct 174 are disposed at positions not facing each other, and thus, occurrence of drift in the left main body duct 174 can be suppressed. In the present embodiment, a distance between the left surface portion 1741 and the right surface portion 1742 of the left main body duct 174 is set to 20 mm or more and 50 mm or less. By setting the distance between the left surface portion 1741 and the right surface portion 1742 to 20 mm or more in this manner, it is possible to suppress the occurrence of drift in the air flow generated inside the left main body duct 174 when air is taken in from the communication ports 1741*a* to 1741*c* and the communication ports 1742*a* to 1742*c*.

For example, when the distance between the left surface portion 1741 and the right surface portion 1742 is smaller than 20 mm, an air flow generated by being taken in by the developing intake fans 180*a* to 180*d* and the charging intake fans 177*a* and 177*b* hits the left surface portion 1741 and the right surface portion 1742, and thus, a drift occurs. When the drift of air flows occurs, a loss of an air volume when air flowing into the left main body duct 174 from the intake port 171*a* is discharged from the communication ports 1741*a* to 1741*c* and the communication ports 1742*a* to 1742*c* becomes large.

Therefore, in the present embodiment, the distance between the left surface portion 1741 and the right surface portion 1742 of the left main body duct 174 is set to 20 mm or more, thereby suppressing the occurrence of drift inside the left main body duct 174. As a result, a loss when the air flowing into the left main body duct 174 from the intake port 171*a* is discharged from the communication ports 1741*a* to 1741*c* and the communication ports 1742*a* to 1742*c* can be suppressed. Therefore, a sufficient air blowing amount can be secured for the plurality of units.

When the distance between the left surface portion 1741 and the right surface portion 1742 is larger than 50 mm, drift is less likely to occur in the left main body duct 174. However, the outer shape of the left main body duct 174 becomes large, and the size of the image forming apparatus itself may be increased in order to accommodate a duct having a large outer shape. Therefore, in the present embodiment, the distance between the left surface portion 1741 and the right surface portion 1742 is set to 40 mm in consideration of the influence of the intake air of each intake fan. In this case, no drift occurs in the left main body duct 174, and an increase in pressure loss can be suppressed.

Right Intake Unit

Next, the right intake unit 126 will be described with reference to FIGS. 4B, 8A, and 8B. As illustrated in FIG. 4B, the right intake unit 126 includes a right main body duct 176, charging intake fans 177*c* and 177*d*, and a passage duct 179 to be described below. The charging intake fans 177*c* and 177*d* are fans for blowing outside air to the charging units 2*c* and 2*d* supported by the first casing 101*a*. The right main body duct 176 is a duct in which a space communicating with the intake port 172*a* (see FIG. 3B) is formed. In order to remove dust and the like from the outside air taken in from the intake port 172*a*, a filter (not illustrated) is preferably disposed in a flow path from the intake port 172*a* to the right main body duct 176.

Figure 8A:
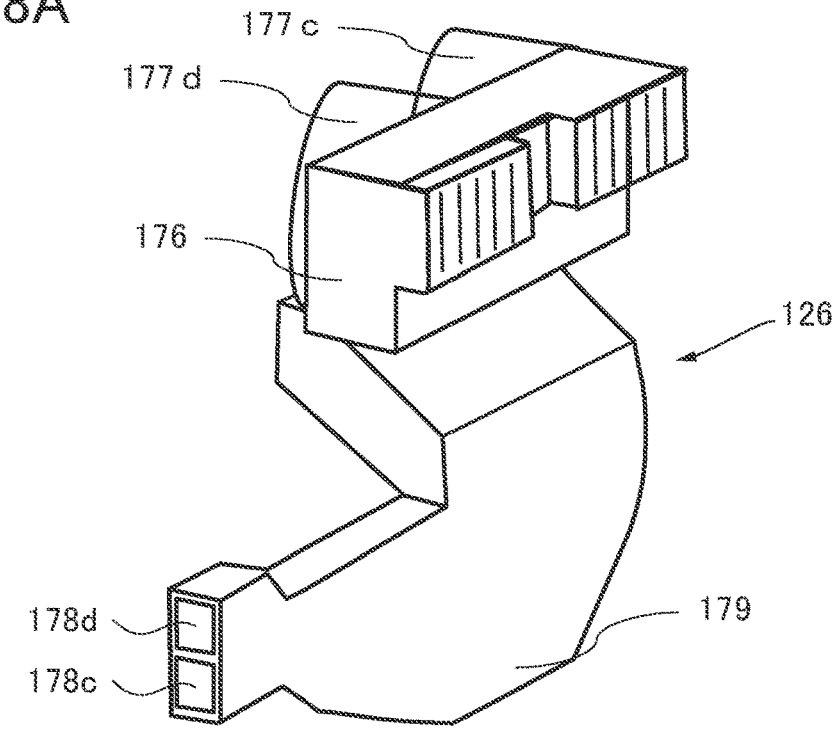
FIG. 8A is a perspective view illustrating a right intake unit.
Figure 8B:
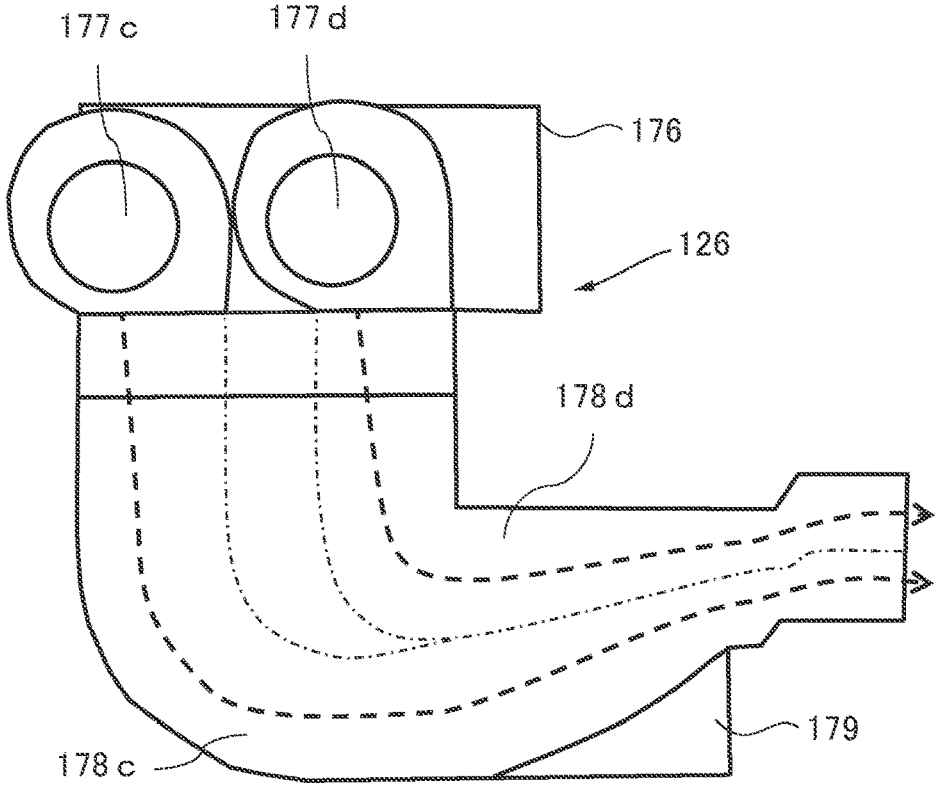
FIG. 8B is a left side view illustrating the right intake unit.

As illustrated in FIG. 8A, the right main body duct 176 is provided with charging intake fans 177*c* and 177*d* for blowing outside air to the charging units 2*c* and 2*d*. That is, a communication port communicating with the charging intake fans 177*c* and 177*d* is formed in the right main body duct 176, and the outside air taken in from the intake port 172*a* according to the operations of the charging intake fans 177*c* and 177*d* passes through the inside of the right main body duct 176. As illustrated in FIG. 8B, charging ducts 178*c* and 178*d* are formed in the passage duct 179. The passage duct 179 is connected to the charging intake fans 177*c* and 177*d* such that the outside air having passed through the charging intake fans 177*c* and 177*d* passes through the charging ducts 178*c* and 178*d*.

Then, as illustrated in FIG. 4B, the outside air taken in from the intake port 172*a* is sent to the charging units 2*c* and 2*d* via the right main body duct 176, the charging intake fans 177*c* and 177*d*, the charging ducts 178*c* and 178*d*, and the inner cover unit 125. Meanwhile, as described above, the outside air taken in from the intake port 171*a* (see FIG. 3B) is sent to the charging units 2*a* and 2*b* via the left main body duct 174, the charging intake fans 177*a* and 177*b*, and the inner cover unit 125. As described above, in the present embodiment, the left intake unit 124 and the right intake unit 126 are used to blow the outside air to the charging units 2*a* to 2*d*.

Note that the air flow configuration of the developing units 1*a* to 1*d* and the air flow configuration of the charging units 2*a* to 2*d* are not limited to the above-described configurations. For example, the developing intake fans 180*a* to 180*d* may be disposed in the right surface portion 1742 of the left intake unit 124, and the charging intake fans 177*a* and 177*b* may be disposed in the left surface portion 1741. That is, the number of intake fans disposed on the left surface portion 1741 and the right surface portion 1742 of the left intake unit 124 may not be the same.

Further, for example, one charging intake fan 177*a* and two developing intake fans 180*a* and 180*b* may be disposed on the left surface portion 1741, and three charging intake fans 177*b*, 177*c*, and 177*d* may be disposed on the right surface portion 1742. At this time, the developing intake fans 180*c* and 180*d* are disposed in the right intake unit 126. In this case, the charging unit 2*a* corresponds to a first charging unit, and the charging units 2*b*, 2*c*, and 2*d* correspond to a second charging unit.

Inner Cover Unit

Figure 9:
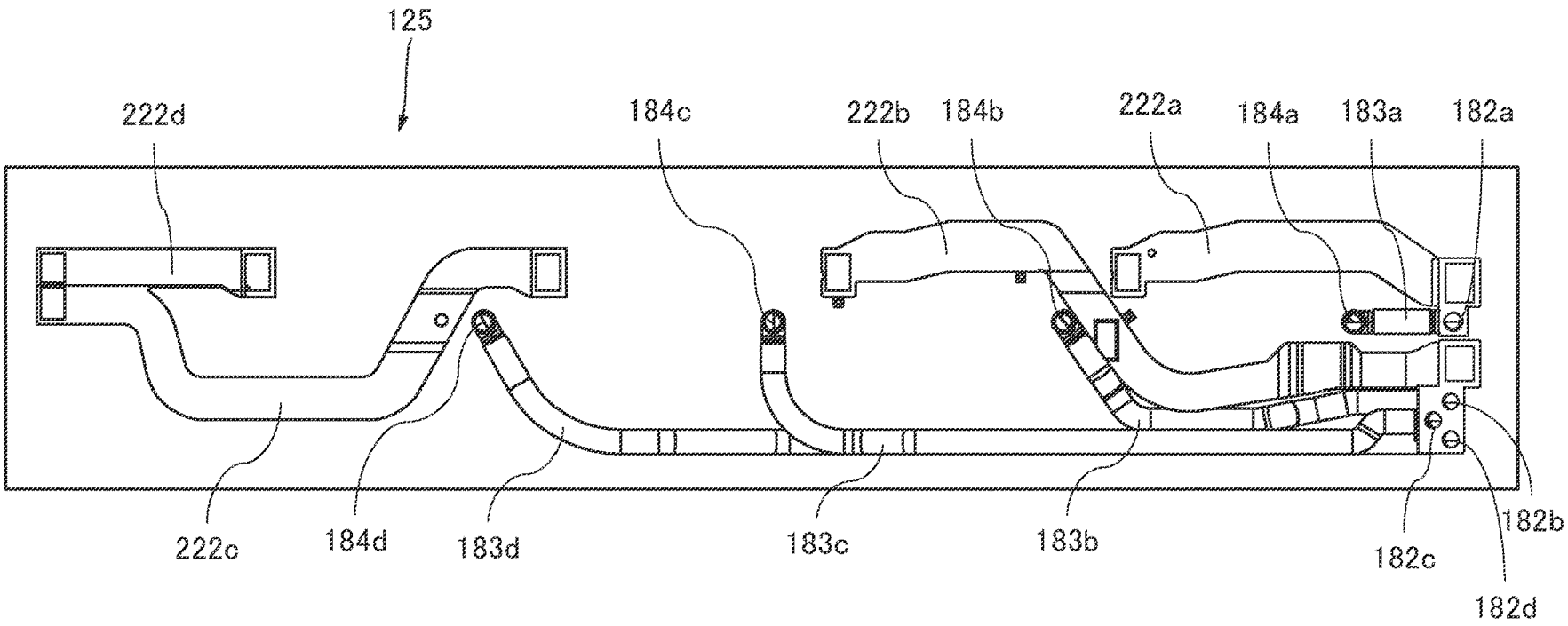
FIG. 9 is a schematic view illustrating an inner surface side of an inner cover unit.

The inner cover unit 125 will be described with reference to FIG. 9. FIG. 9 is a schematic view illustrating an inner surface side of the inner cover unit 125. In the present embodiment, as illustrated in FIG. 9, a flexible tube 183*a* serving as the first relay duct and flexible tubes 183*b*, 183*c*, and 183*d* as the second relay ducts are disposed on the inner surface side of the inner cover unit 125 as relay ducts through which outside air for cooling the developing units 1*a* to 1*d* passes. Flexible tubes 222*a*, 222*b*, 222*c*, and 222*d* are disposed on the inner surface side of the inner cover unit 125 as relay ducts through which outside air for blowing air to the charging units 2*a* to 2*d* passes. The flexible tubes 183*a* to 183*d* and 222*a* to 222*d* are attached to the inner surface of the inner cover unit 125 using, for example, a wire saddle.

Each of the flexible tubes 183*a* to 183*d* and 222*a* to 222*d* is a bellows-shaped tubular member of which an inside is formed in a hollow tubular shape using, for example, a resin such as PA6 (polyamide) or a metal, and a large number of protrusions are continuously formed at predetermined intervals on the outer peripheral surface, and is bendable. When the flexible tubes 183*a* to 183*d* and 222*a* to 222*d* are curved, the curvature is limited by the protrusion inside the curve (compression side) and it is difficult to bend the flexible tubes. Therefore, even when the flexible tubes 183*a* to 183*d* and 222*a* to 222*d* are curved, the size of the cross-sectional area is maintained as compared with that before the curvature, and the outside air can be guided without changing the air volume per unit time.

With the operations of the developing intake fans 180*a* to 180*d*, the outside air taken in from the intake port 171*a* passes through the left main body duct 174, the developing ducts 181*a* to 181*d*, and the flexible tubes 183*a* to 183*d* and flows toward the developing units 1*a* to 1*d*. Further, with the operation of the charging intake fans 177*a* and 177*b*, the outside air taken in from the intake port 171*a* passes through the left main body duct 174, the charging ducts 178*a* and 178*b*, and the flexible tubes 222*a* and 222*b* and flows toward the charging units 2*a* and 2*b*. Further, with the operation of the charging intake fans 177*c* and 177*d*, the outside air taken in from the intake port 172*a* passes through the right main body duct 176, the charging ducts 178*c* and 178*d*, and the flexible tubes 222*c* and 222*d* and flows toward the charging units 2*c* and 2*d*.

In the present embodiment, on the inner surface side of the inner cover unit 125, for example, the flexible tubes 183*a* to 183*d* can be appropriately curved and provided in gaps avoiding the flexible tubes 222*a* to 222*d* and the like that guide outside air to the charging units 2*a* to 2*d*. That is, the use of the flexible tubes 183*a* to 183*d* and 222*a* to 222*d* increases the degree of freedom of duct arrangement in a limited space. Note that the arrangement of the flexible tubes 183*a* to 183*d* and 222*a* to 222*d* illustrated here is an example, and the arrangement is not limited thereto.

As described above, in the present embodiment, in the left intake unit 124, the developing intake fan 180*a* and the charging intake fans 177*a* and 177*b* are disposed on the left surface portion of the left main body duct 174. Meanwhile, the developing intake fans 180*b*, 180*c*, and 180*d* are disposed on the right surface portion 1742 of the left main body duct 174. In the left intake unit 124, the outside air taken in from the intake port 171*a* according to the operations of the developing intake fans 180*a* to 180*d* and the charging intake fans 177*a* and 177*b* is branched into the communication ports 1741*a* to 1741*c* and the communication ports 1742*a* to 1742*c* and blown to the developing units 1*a* to 1*d* and the charging units 2*a* and 2*b*. Accordingly, when the outside air taken in by the intake fan is guided toward the plurality of units via the duct, it is possible to suppress an increase in size of the apparatus and to realize a simple configuration to guide the outside air with a sufficient air blowing amount secured.

Other Embodiments

Figure 10A:
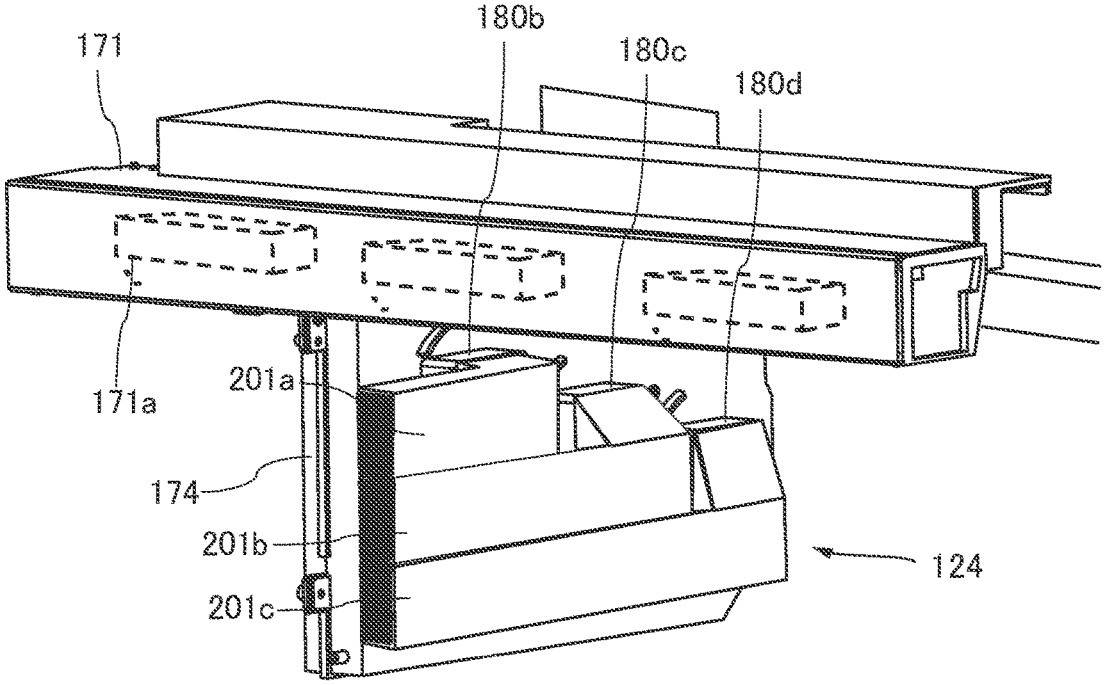
FIG. 10A is a right perspective view illustrating the left intake unit when an axial fan is used.
Figure 10B:
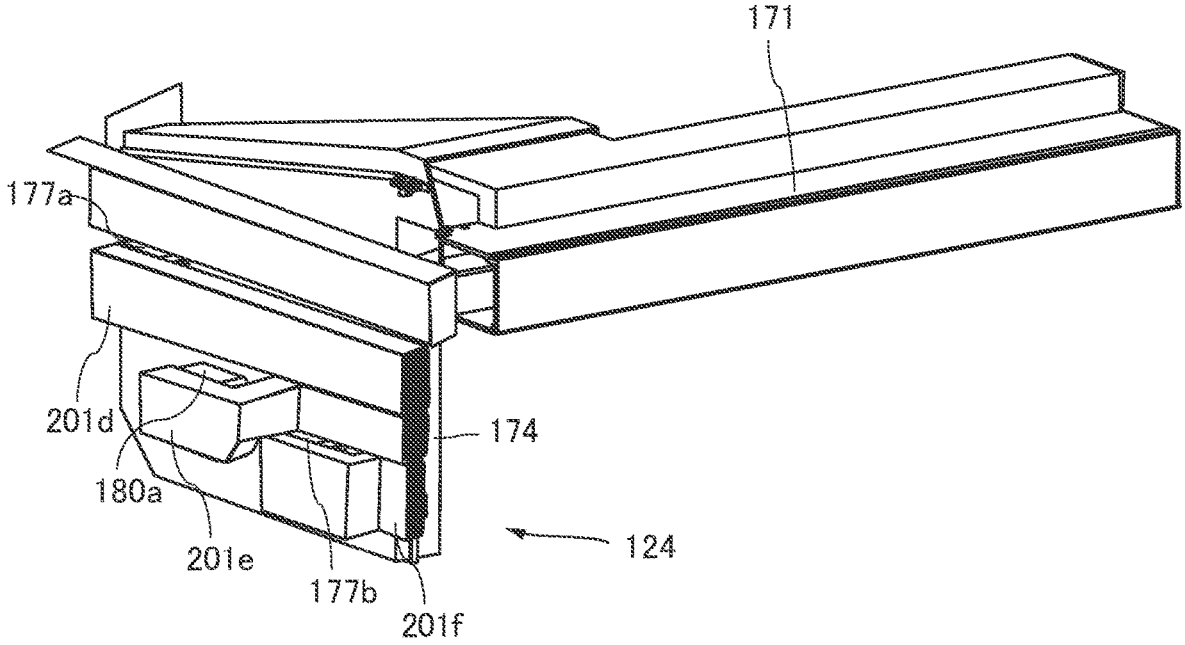
FIG. 10B is a left perspective view illustrating the left intake unit when the axial fan is used.

In the embodiment described above, the sirocco fan is used as the intake fan as an example, but the present invention is not limited to this. An axial fan may be used as the intake fan. FIGS. 10A and 10B illustrate a case where an axial fan is used instead of the sirocco fan for the developing intake fans 180*b*, 180*c*, and 180*d* and the charging intake fans 177*a* and 177*b* in the left main body duct 174.

As illustrated in FIGS. 10A and 10B, when the axial fans are used for the developing intake fans 180*a* to 180*d* and the charging intake fans 177*a* and 177*b*, side ducts 201*a* to 201*f* are individually provided for each fan. Here, the side duct 201*e* is provided for the developing intake fan 180*a*, the side duct 201*a* is provided for the developing intake fan 180*b*, the side duct 201*b* is provided for the developing intake fan 180*c*, and the side duct 201*c* is provided for the developing intake fan 180*d*. The side duct 201*d* is provided for the charging intake fan 177*a*, and the side duct 201*f* is provided for the charging intake fan 177*b*. As illustrated in the drawing, the side ducts 201*a* to 201*f* are provided so as to cover the exhaust sides of the developing intake fans 180*a* to 180*d* and the charging intake fans 177*a* and 177*b*. Other configurations in the case of using the axial fan are similar to the configurations in the case of using the sirocco fan described above, and thus the description thereof is omitted here.

In the above-described embodiment, the case where outside air is blown to the developing units 1*a* to 1*d* and the charging units 2*a* to 2*d* has been described as an example, but the present invention is not limited thereto. For example, the above-described embodiment may also be applied to a case where a conveyance member that conveys the recording material S after passing through the first fixing device 81 and the second fixing device 91 (see FIG. 1) is cooled by outside air.

Note that, in the above-described embodiment, the electrophotographic image forming apparatus 100 is described as an example, but the present invention is not limited thereto. For example, the above-described embodiments may be applied to a thermal drying type image forming apparatus such as an inkjet printer or a sublimation type printer.

According to the present invention, when the outside air taken in by the intake fan is guided toward the plurality of units via the duct, it is possible to suppress an increase in size of the device and to realize a simple configuration to guide the outside air with a sufficient air blowing amount secured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-100083, filed Jun. 16, 2021, which is hereby incorporated by reference herein in its entirety.

What is claimed is:

1. An image forming apparatus configured to form an image on a recording material, comprising:

a first image forming unit among a plurality of image forming units, the first image forming unit having a first photosensitive member, a first charging unit configured to charge the first photosensitive member by corona discharge, and a first developing unit configured to develop an electrostatic latent image formed on the first photosensitive member using toner;

a second image forming unit among the plurality of image forming units, the second image forming unit having a second photosensitive member, a second charging unit configured to charge the second photosensitive member by corona discharge, and a second developing unit configured to develop an electrostatic latent image formed on the second photosensitive member using toner; and an intake unit including an intake duct provided at one side relative to the first and the second image forming units in an arrangement direction of the plurality of image forming units and configured to take in air outside the image forming apparatus from an intake port, a first fan configured to take in air from a first communication port formed in a first side surface portion of the intake duct, and a second fan configured to take in air from a second communication port formed in a second side surface portion facing the first side surface portion of the intake duct, wherein the intake unit is configured to branch air in the intake duct to the air taken in from the first communication port by the first fan and the air taken in from the second communication port by the second fan, and blow the air to each of the first image forming unit and the second image forming unit, and wherein the intake unit includes a branch portion configured to branch an air flow so as to guide the air taken in by the first fan to the first charging unit and guide the air taken in by the second fan to the second charging unit.

2. The image forming apparatus according to claim 1, wherein the first communication port and the second communication port are provided at positions not overlapping each other in a case where the first side surface portion side is viewed from the second side surface portion side in an opposing direction where the first side surface portion and the second side surface portion are facing each other.

3. The image forming apparatus according to claim 1, wherein a distance between the first side surface portion and the second side surface portion is 20 mm or more and 50 mm or less in an opposing direction where the first side surface portion and the second side surface portion are facing each other.

4. The image forming apparatus according to claim 1, wherein the first fan is a sirocco fan or an axial fan, and the second fan is a sirocco fan or an axial fan.

5. The image forming apparatus according to claim 4, wherein the first communication port and the second communication port are provided at positions not overlapping each other in a case where the first side surface portion side is viewed from the second side surface portion side in a rotation axis direction of the first fan.

6. The image forming apparatus according to claim 1, further comprising:

a casing supporting the first image forming unit and the second image forming unit;

an exterior cover provided to be openable and closable with respect to the casing at a position on a front side of the casing; and an inner cover unit arranged to face an inner surface of the exterior cover in a state where the exterior cover is closed with respect to the casing, wherein the intake unit includes a first duct configured to guide the air taken in from the first communication port and a second duct configured to guide the air taken in from the second communication port, and wherein the inner cover unit includes a first relay duct connected to the first duct and configured to guide the air taken in from the first communication port toward the first image forming unit, and a second relay duct connected to the second duct and configured to guide the air taken in from the second communication port toward the second image forming unit.

7. The image forming apparatus according to claim 1, further comprising:

a third image forming unit positioned between the first image forming unit and the second image forming unit in the arrangement direction, the third image forming unit including a third photosensitive member, a third charging unit configured to charge the third photosensitive member by corona discharge, and a third developing unit configured to develop an electrostatic latent image formed on the third photosensitive member using toner; and a fourth image forming unit positioned between the second image forming unit and the third image forming unit in the arrangement direction, the fourth image forming unit including a fourth photosensitive member, a fourth charging unit configured to charge the fourth photosensitive member by corona discharge, and a fourth developing unit configured to develop an electrostatic latent image formed on the fourth photosensitive member using toner, wherein the intake unit further includes a third fan configured to take in air from a third communication port formed in the second side surface portion of the intake duct, and a fourth fan configured to take in air from a fourth communication port formed in the second side surface portion of the intake duct, and wherein the intake unit includes a branch portion configured to branch an air flow so as to guide the air taken in by the first fan to the first developing unit, guide the air taken in by the second fan to the second developing unit, guide the air taken in by the third fan to the third developing unit, and guide the air taken in by the fourth fan to the fourth developing unit.

8. An image forming apparatus configured to form an image on a recording material, comprising:

a first image forming unit among a plurality of image forming units, the first image forming unit having a first photosensitive member, a first charging unit configured to charge the first photosensitive member by corona discharge, and a first developing unit configured to develop an electrostatic latent image formed on the first photosensitive member using toner;

a second image forming unit among the plurality of image forming units, the second image forming unit having a second photosensitive member, a second charging unit configured to charge the second photosensitive member by corona discharge, and a second developing unit configured to develop an electrostatic latent image formed on the second photosensitive member using toner; and an intake unit including an intake duct provided at one side relative to the first and the second image forming units in an arrangement direction of the plurality of image forming units and configured to take in air outside the image forming apparatus from an intake port, a first fan configured to take in air from a first communication port formed in a first side surface portion of the intake duct, and a second fan configured to take in air from a second communication port formed in a second side surface portion facing the first side surface portion of the intake duct, wherein the intake unit is configured to branch air in the intake duct to the air taken in from the first communication port by the first fan and the air taken in from the second communication port by the second fan, and blow the air to each of the first image forming unit and the second image forming unit, and wherein the intake unit includes a branch portion configured to branch an air flow so as to guide the air taken in by the first fan to the first developing unit and guide the air taken in by the second fan to the second developing unit.

9. The image forming apparatus according to claim 8, wherein the first communication port and the second communication port are provided at positions not overlapping each other in a case where the first side surface portion side is viewed from the second side surface portion side in an opposing direction where the first side surface portion and the second side surface portion are facing each other.

10. The image forming apparatus according to claim 8, wherein a distance between the first side surface portion and the second side surface portion is 20 mm or more and 50 mm or less in an opposing direction where the first side surface portion and the second side surface portion are facing each other.

11. The image forming apparatus according to claim 8, wherein the first fan is a sirocco fan or an axial fan, and the second fan is a sirocco fan or an axial fan.

12. The image forming apparatus according to claim 11, wherein the first communication port and the second communication port are provided at positions not overlapping each other in a case where the first side surface portion side is viewed from the second side surface portion side in a rotation axis direction of the first fan.

13. The image forming apparatus according to claim 8, further comprising:

a casing supporting the first image forming unit and the second image forming unit;

an exterior cover provided to be openable and closable with respect to the casing at a position on a front side of the casing; and an inner cover unit arranged to face an inner surface of the exterior cover in a state where the exterior cover is closed with respect to the casing, wherein the intake unit includes a first duct configured to guide the air taken in from the first communication port and a second duct configured to guide the air taken in from the second communication port, and wherein the inner cover unit includes a first relay duct connected to the first duct and configured to guide the air taken in from the first communication port toward the first image forming unit, and a second relay duct connected to the second duct and configured to guide the air taken in from the second communication port toward the second image forming unit.

14. The image forming apparatus according to claim 8, further comprising:

a third image forming unit positioned between the first image forming unit and the second image forming unit in the arrangement direction, the third image forming unit including a third photosensitive member, a third charging unit configured to charge the third photosensitive member by corona discharge, and a third developing unit configured to develop an electrostatic latent image formed on the third photosensitive member using toner; and a fourth image forming unit positioned between the second image forming unit and the third image forming unit in the arrangement direction, the fourth image forming unit including a fourth photosensitive member, a fourth charging unit configured to charge the fourth photosensitive member by corona discharge, and a fourth developing unit configured to develop an electrostatic latent image formed on the fourth photosensitive member using toner, wherein the intake unit further includes a third fan configured to take in air from a third communication port formed in the second side surface portion of the intake duct, and a fourth fan configured to take in air from a fourth communication port formed in the second side surface portion of the intake duct, and wherein the intake unit includes a branch portion configured to branch an air flow so as to guide the air taken in by the first fan to the first developing unit, guide the air taken in by the second fan to the second developing unit, guide the air taken in by the third fan to the third developing unit, and guide the air taken in by the fourth fan to the fourth developing unit.

15. An image forming apparatus configured to form an image on a recording material, comprising:

a first image forming unit among a plurality of image forming units, the first image forming unit having a first photosensitive member, a first charging unit configured to charge the first photosensitive member by corona discharge, and a first developing unit configured to develop an electrostatic latent image formed on the first photosensitive member using toner;

a second image forming unit among the plurality of image forming units, the second image forming unit having a second photosensitive member, a second charging unit configured to charge the second photosensitive member by corona discharge, and a second developing unit configured to develop an electrostatic latent image formed on the second photosensitive member using toner;

an intake unit including an intake duct provided at one side relative to the first and the second image forming units in an arrangement direction of the plurality of image forming units and configured to take in air outside the image forming apparatus from an intake port, a first fan configured to take in air from a first communication port formed in a first side surface portion of the intake duct, and a second fan configured to take in air from a second communication port formed in a second side surface portion facing the first side surface portion of the intake duct;

a third image forming unit positioned between the first image forming unit and the second image forming unit in the arrangement direction, the third image forming unit including a third photosensitive member, a third charging unit configured to charge the third photosensitive member by corona discharge, and a third developing unit configured to develop an electrostatic latent image formed on the third photosensitive member using toner; and a fourth image forming unit positioned between the second image forming unit and the third image forming unit in the arrangement direction, the fourth image forming unit including a fourth photosensitive member, a fourth charging unit configured to charge the fourth photosensitive member by corona discharge, and a fourth developing unit configured to develop an electrostatic latent image formed on the fourth photosensitive member using toner, wherein the intake unit is configured to branch air in the intake duct to the air taken in from the first communication port by the first fan and the air taken in from the second communication port by the second fan, and blow the air to each of the first image forming unit and the second image forming unit, wherein the intake unit further includes a third fan configured to take in air from a third communication port formed in the second side surface portion of the intake duct, and a fourth fan configured to take in air from a fourth communication port formed in the second side surface portion of the intake duct, and wherein the intake unit includes a branch portion configured to branch an air flow so as to guide the air taken in by the first fan to the first developing unit, guide the air taken in by the second fan to the second developing unit, guide the air taken in by the third fan to the third developing unit, and guide the air taken in by the fourth fan to the fourth developing unit.

16. The image forming apparatus according to claim 15, wherein the first communication port and the second communication port are provided at positions not overlapping each other in a case where the first side surface portion side is viewed from the second side surface portion side in an opposing direction where the first side surface portion and the second side surface portion are facing each other.

17. The image forming apparatus according to claim 15, wherein a distance between the first side surface portion and the second side surface portion is 20 mm or more and 50 mm or less in an opposing direction where the first side surface portion and the second side surface portion are facing each other.

18. The image forming apparatus according to claim 15, wherein the first fan is a sirocco fan or an axial fan, and the second fan is a sirocco fan or an axial fan.

19. The image forming apparatus according to claim 18, wherein the first communication port and the second communication port are provided at positions not overlapping each other in a case where the first side surface portion side is viewed from the second side surface portion side in a rotation axis direction of the first fan.

20. The image forming apparatus according to claim 15, further comprising:

a casing supporting the first image forming unit and the second image forming unit;

an exterior cover provided to be openable and closable with respect to the casing at a position on a front side of the casing; and an inner cover unit arranged to face an inner surface of the exterior cover in a state where the exterior cover is closed with respect to the casing, wherein the intake unit includes a first duct configured to guide the air taken in from the first communication port and a second duct configured to guide the air taken in from the second communication port, and wherein the inner cover unit includes a first relay duct connected to the first duct and configured to guide the air taken in from the first communication port toward the first image forming unit, and a second relay duct connected to the second duct and configured to guide the air taken in from the second communication port toward the second image forming unit.

* * * * *